United States Patent [19]

Kobayashi et al.

[11] Patent Number: 4,697,565

[45] Date of Patent: Oct. 6, 1987

[54] DISTRIBUTOR-TYPE FUEL INJECTION PUMP

[75] Inventors: Tadashi Kobayashi; Shinya Nozaki, both of Higashi-Matsuyama, Japan

[73] Assignee: Diesel Kiki Co., Ltd., Tokyo, Japan

[21] Appl. No.: 813,764

[22] Filed: Dec. 27, 1985

[30] Foreign Application Priority Data

Dec. 28, 1984 [JP] Japan ..... 59-197537[U]

[51] Int. Cl.[4] ..... F02M 39/00

[52] U.S. Cl. ..... 123/449; 123/506; 123/509; 417/372

[58] Field of Search ..... 123/449, 506, 509; 417/372, 490

[56] References Cited

U.S. PATENT DOCUMENTS 2,670,684 3/1954 Fagerholt ..... 417/372
3,401,572 9/1968 Bailey ..... 123/501
4,475,507 10/1984 Miyaki ..... 123/458
4,546,749 10/1985 Igashira ..... 123/458
4,586,480 5/1986 Kobayashi ..... 123/506

*Primary Examiner*—Carl Stuart Miller
*Attorney, Agent, or Firm*—Wenderoth, Lind & Ponack

[57] ABSTRACT

A distributor-type fuel injection pump of the type including a magnetic valve disposed on the head portion of a pump body, wherein a pair of oil seals is disposed on opposite sides of the feed pump, and a bypass passage bypasses the cam chamber and connects a discharge side of the feed pump and an inlet side of the magnetic valve. With this construction, the fuel is delivered without passing through the cam chamber. On the other hand, the lubrication oil is introduced into the cam chamber through clearances between the drive shaft and the bearings and through passageways defined in the drive shaft. The cam assembly or other movable components are lubricated exclusively with the lubrication oil, so that the fuel injection pump operates stably over an extended period of time.

6 Claims, 2 Drawing Figures

DISTRIBUTOR-TYPE FUEL INJECTION PUMP

BACKGROUND OF THE INVENTION

1. Field of the Invention

The present invention relates to a distributor-type fuel injection pump for use in a diesel engine, and more particularly to such fuel injection pump having an improved lubrication oil supply mechanism.

2. Prior Art

Bosch pumps or distributor-type fuel injection pumps generally comprise a feed pump disposed in a pump body adjacent to the rear side thereof and a cam chamber defined between the fuel pump and a head portion of the pump body. A drive shaft and a plunger are coupled together within the cam chamber through a cam so that the plunger makes rotational and reciprocating motions simultaneously, in unison with the rotation of the drive shaft.

In general, the cam chamber is utilized as a fuel chamber for receiving a fuel delivered from the fuel pump. The fuel thus received lubricates the cam and other movable components in the cam chamber. However, because of its low viscosity, the fuel gives only an insufficient lubrication which would result in a short service time of the pump. With the foregoing difficulty in view, it has been a long desire to devise a pump wherein a lubrication oil is supplied into the cam chamber for exclusively lubricating the cam and other components in the cam chamber.

One prior attempt proposed to meet this desire is disclosed in Japanese Patent Laid-open Publication No. 56-154135, wherein a magnetic valve is disposed on the head portion of a fuel injection pump body for controlling the flow of a fuel delivered from a pump working chamber defined between a cylinder and a plunger. With the magnetic valve thus provided, a governor and a control sleeve are displaced and it becomes possible to introduce a lubrication oil into the cam chamber. According to another attempt shown in Japanese Patent Laid-open Publication No. 56-88957, a fuel injection pump includes a cam chamber which is divided into a first compartment for receiving a cam and a second compartment for receiving a control sleeve, a lubrication oil being delivered into the first compartment.

In the aforementioned fuel injection pumps, the lubrication oil is supplied directly into the cam chamber or the first compartment through an inlet defined therein, without agency of any control means for adjusting the supply of the lubrication oil. With this construction, it is likely that an excess amount of lubrication oil is introduced into the cam chamber or the first compartment. This difficulty may be overcome by a control means separately provided for controlling the supply of the lubrication oil. However, provision of such a control means would cause another drawback such that the number of parts or components becomes large and hence the fuel injection pump is complex in structure and hence is complex in construction.

SUMMARY OF THE INVENTION

With the foregoing difficulties in view, an object of the present invention is to provide a distributor-type fuel injection pump having an improved lubrication oil supply mechanism which is simple in construction and capable of maintaining an adequate supply of a lubrication oil to a cam chamber of the fuel injection pump.

The foregoing and other objects of the present invention are attained by a distributor-type fuel injection pump comprising a pair of oil seals mounted around a drive shaft of the pump and disposed on opposite sides of a feed pump operatively disposed in a pump body, a first passageway defined in a rear portion of the pump body and communicating with a drive-shaft revieving bore between the bearings for introducing a lubrication oil into a space defined between the bore, drive shaft and bearings, at least one second oil passageway extending radially in the drive shaft and opening at one end to one of the bearings, a third oil passageway extending axially in the drive shaft and communicating the second oil passageway with a cam chamber defined in the pump body, and a bypass passage bypassing the cam chamber and communicating a discharge side of the feed pump with an inlet side of the fuel passage of a magnetic valve.

With this construction, the feed pump is held out of fluid communication with the cam chamber by means of the oil seals so that the fuel is supplied from the feed pump into the pump working chamber through the bypass passage and the magnetic valve while the lubrication oil is supplied into the cam chamber through the first to third oil passageways. Owing to the bearings interposed between the first and second oil passageways, the flow of lubrication oil is limited or reduced when the lubrication oil flows from the first oil passageway and the second oil passageway, whereby a controlled amount of lubrication oil is supplied to the cam chamber.

Many other advantages and features of the present invention will become manifest to those versed in the art upon making reference to the detailed description and the accompanying sheets of drawings in which a preferred structural embodiments incorporating the principles of the present invention is shown by way of illustrative example.

DETAILED DESCRIPTION OF THE PREFERRED EMBODIMENT

Figure 1:
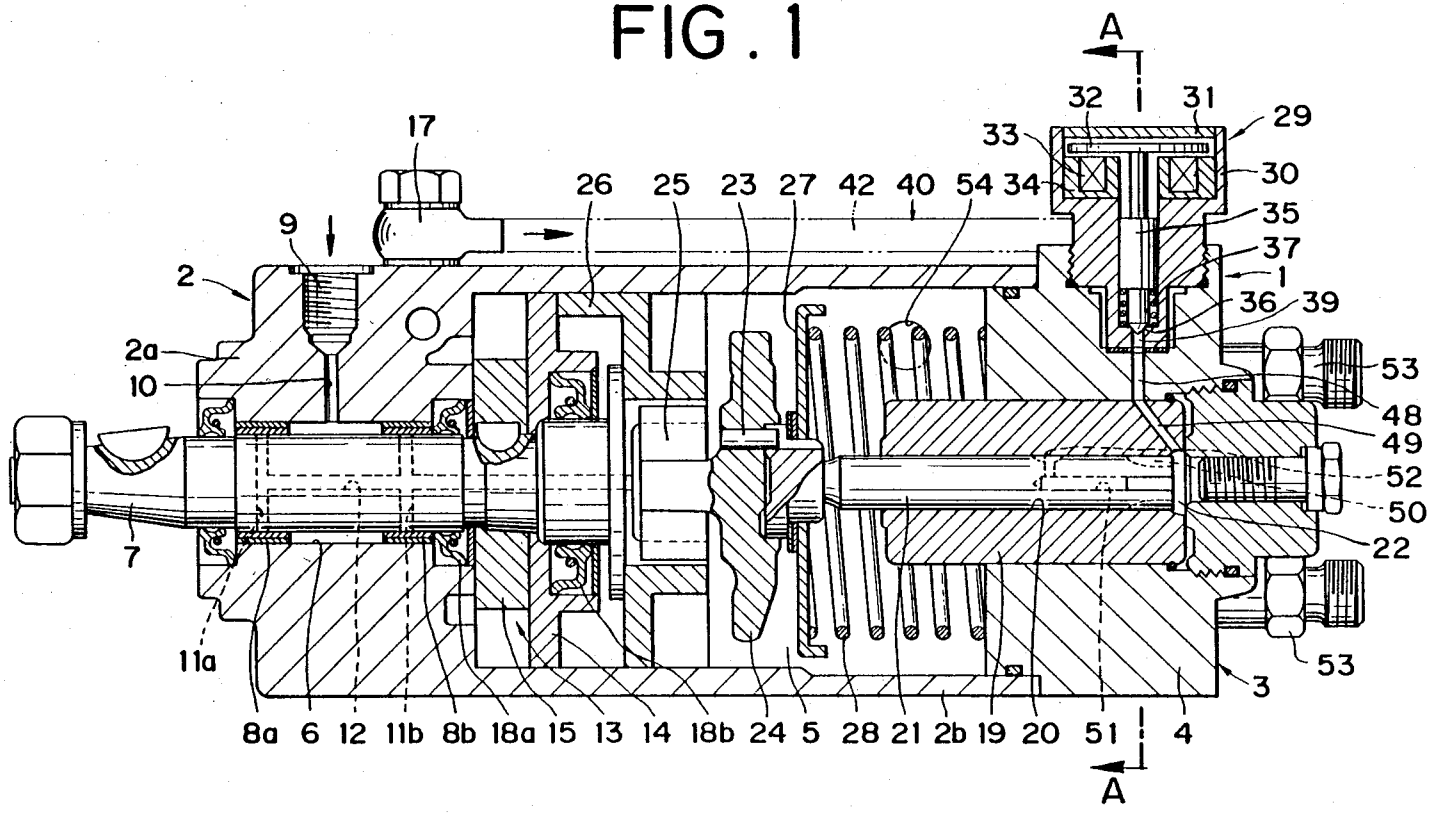
FIG. 1 is a longitudinal cross-sectional view of a distributor-type fuel injection pump embodying the present invention.

As shown in FIG. 1, a fuel injection pump embodying the present invention includes a pump body 1 composed of a rear body portion 2 and a front or head portion 3 connected together. The rear body portion 2 has a rear portion 2*a* and a hollow cylindrical portion 2*b* extending integrally from the rear portion 2*a* toward the head portion 3 and secured to a head body portion 4 of the head portion 3. The pump body 1 also includes a cam chamber 5 defined beween the rear body portion 2 and the head portion 3.

The rear portion 2*a* has a central horizontal bore 6 in which a drive shaft 7 is rotatably mounted via a pair of spaced bearings 8*a*, 8*b* disposed between the bore 6 and the shaft 7. The bearings 8*a*, 8*b* in the illustrated embodiment comprise plain bearings. The drive shaft 7 has one end projecting outwardly from the rear portion 2*a* and adapted to be coupled in driven relation with an engine crankshaft (not shown). The other end of the drive shaft 7 extends into the cam chamber 5.

A lubrication oil inlet 9 is defined in an upper part of the rear portion 2*a* for receiving therefrom a lubrication oil such as an engine oil. The inlet 9 communicates with the bore 6 between the bearings 8*a*, 8*b* through a first oil passageway 10 defined in the rear portion 2*a* so as to introduce the lubriction oil into a space defined between the bore 6, the drive shaft 7 and the bearings 8*a*, 8*b*. The drive shaft 7 has a pair of second oil passageways 11*a*, 11*b* extending diametrically therethrough and opening at opposite ends to inner peripheral surfaces of the respective bearings 8*a*, 8*b*, and a third oil passageway 12 extending axially in the shaft 7 to communicate the second oil passages 11*a*, 11*b* with the cam chamber 5.

A feed pump 13 is of the vane type and disposed in the pump body 1 adjacent to the rear portion 2*a*. The feed pump 13 includes a side block 14 separating the pump 13 from the cam chamber 5, and a rotor 15 rotatably disposed between the side block 14 and an inner end of the rear portion 2*a*. The rotor 15 is secured to the drive shaft 7 and includes a plurality of vanes (not shown) radially slidably mounted therein so that upon rotation of the drive shaft 7, the vanes slide along the inner periphery of a housing (not shown) to suck a fuel from a non-illustrated inlet defined in the rear portion 2*a*, then to compress the fuel and finally to discharge the fuel under pressure from an outlet 17 provided on the rear portion 2*a*. A pair of oil seals 18*a*, 18*b* is mounted around the drive shaft 7 and is disposed one on each side of the feed pump 13. One of the oil seals 18*a* provides a fluid-tight seal between the bore 6 and the feed pump 13 while the other oil seal 18*b* provides a fluid-tight seal between the cam chamber 5 and the feed pump 13.

A plunger barrel 19 is mounted centrally in the head body portion 4 and has an axial bore 20 in which a plunger 21 is movably received, the bore 20 and the plunger 21 jointly defining therebetween a pump working chamber 22. The plunger 21 has one end disposed in the cam chamber 5 and connected by a pin 23 to a cam disc 24. The cam disc 24 is axially movably connected to the other end of the drive shaft 7 by means of a jaw coupling 25. A roller holder 26 is disposed circumferentially around the coupling 25 and secured to the pump body 1. The roller holder 26 retains thereon a plurality of rollers (not shown) held in engagement with cam surface defined on an end wall of the coupling 25. The rollers and the cam surface jointly constitute a cam assembly and they are forced against each other by a compression coil spring 28 which is disposed between the head portion 3 and a circular spring retainer 27. The spring retainer 27 is mounted around the plunger 21 adjacent to the end surface thereof. With this construction, when the drive shaft 7 is rotated, rotary motion is transferred through the coupling 25 and the cam disc 24 to the plunger 21. At the same time, reciprocating motion is given to the plunger 21 by the cam assembly. Thus, the plunger 21 makes rotational and reciprocating motions simultaneously, in unison with the rotation of the drive shaft 7.

A magnetic valve 29 includes a valve body 30 threaded to an upper part of the head body portion 4 and a cover 31 secured to an upper end of the valve body 30 with an armature 32 movably interposed therebetween. An annular stator 34 is fixedly mounted in the valve body 30 in confronting relation to the armature 32, the stator 34 having an exciting coil 33 for energizing the stator 34. A valve rod 35 extends centrally downwardly from the armature 32 through the stator 34 toward a valve seat 36 defined in the valve body 30. A compression coil spring 37 is disposed between the valve body 30 and the valve rod 35 to urge the latter upwardly away from the valve seat 35. With the magnetic valve 29 thus constructed, when the exciting current is supplied to the coil 33, the stator 34 is energized whereupon the armature 32 and the valve rod 35 are pulled downwardly against the force of the spring 37, thereby bringing a distal end of the valve rod 35 into engagement with the valve seat 36. As a result, flow communication between an inlet 38 (FIG. 2) and an outlet 39 is interrupted, the inlet 39 and the outlet 38 being defined in the head body portion 4.

Figure 2:
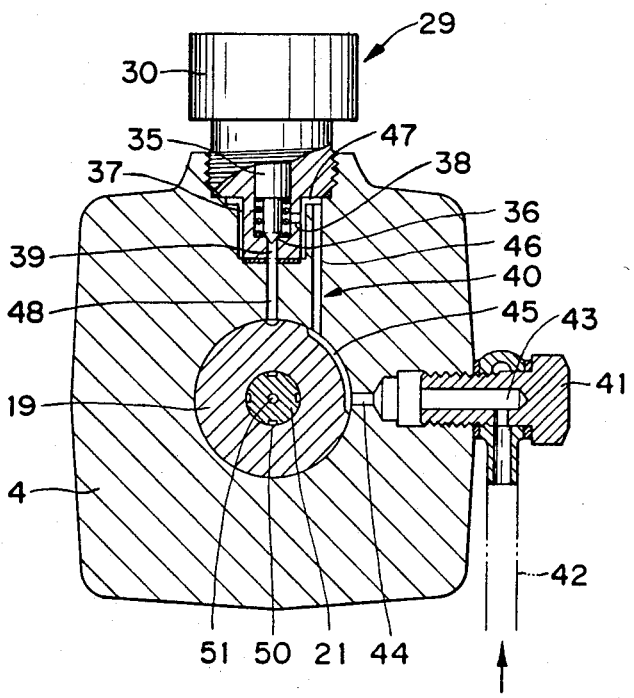
FIG. 2 is a cross-sectional view taken along line A—A of FIG. 1.

As shown in FIG. 2, the inlet 38 of the magnetic valve 29 communicates with the fuel outlet 17 (FIG. 1) through a bypass passage 40. The bypass passage 40 is constituted by a pipe 41 disposed outside of the pump body 1 and connecting the fuel outlet 17 with a connector 41 threaded to the head body portion 4, a first suction groove 43 defined in said connector 41, a second suction groove 44 defined laterally in the head body portion 4, a third suction groove 45 defined in the peripheral surface of the barrel 19, a fourth suction groove 46 extending vertically in the head body portion 4, and a fifth suction groove 47 defined between the head body portion 4 and the valve body 29. The outlet 39 of the magnetic valve 29 communicates with the pump working chamber 22 through a sixth suction groove 48 defined in the head body portion 4 and a seventh suction groove 49 (FIG. 1) extending in the barrel 15.

The plunger 21 has a plurality of axial suction grooves 50 corresponding in number to the number of engine cylinders (not shown) and extending from the other end toward the one end of the plunger 21. The plunger 21 also includes a central longitudinal groove 51 opening at one end to the pump working chamber 22, the other end of the groove 51 communicating with a radial discharge groove 52. The discharge groove 52 is communicatable with a plurality of distributing grooves (not shown) defined in the head body portion 4, the distributing grooves corresponding in number with the number of the engine cylinders and held in communication with the corresponding delivery portion 53 each having delivery valves (not shown).

An oil overflow port 54 is defined in the cylindrical portion 2*b* and communicates with the cam chamber 5 at a level slightly below an upper end of the cam chamber for allowing the lublication oil to flow outwardly through the port 54 into a tank (not shown) when the level of the lubrication oil exceeds the level of port 54.

The fuel injection pump thus constructed operates as follows: When the drive shaft 7 is rotated, the feed pump 13 is operated by the drive shaft 7 to suck the fuel from the non-illustrated fuel inlet into the fuel pump 13 in which the fuel is pressurized and then discharged from the fuel outlet 17 under pressure. The discharged fuel flows through the bypass passage 40 into the inlet 38 of the magnetic valve 29. At the same time, the rotational motion of the drive shaft 7 is transmitted through the coupling 25 and the cam disc 24 to the plunger 21, thereby simultaneously rotating and reciprocating the plunger 21. The fuel pressure in the pump working chamber 22 decreases as the plunger is retracted during the suction stroke. On the contrary, in the compression stroke, the plunger 21 advances to increase the fuel pressure in the pump working chamber 22.

In the suction stroke, the exciting coil 33 is de-energized whereupon the magnetic valve 29 is opened so that the fuel, which has been delivered from the feed pump 13 to the inlet 39 of the magnetic valve 29, is allowed to flow successively through an orifice between the valve rod 35 and the valve seat 36, the outlet 39 of the magnetic valve 29, the sixth suction groove 48 and the seventh suction groove 49 into the pump working chamber 22. Then the exciting current is supplied to the exciting coil 33 to close the magnetic valve 29, thereby terminating suction of the fuel into the pump working chamber 22. Thus, opening and closing operation of the magnetic vlave 29 controls the amount of fuel to be sucked into the pump working chamber 22. Then the plunger 21 begins its compression stroke wherein the fuel in the pump working chamber 22 is pressurized as the plunger 21 advances. The pressurized fuel is delivered through the longitudinal groove 51 and the discharge groove 52 of the plunger 21, and through the non-illustrated delivery grooves to the delivery portions 53 from which the fuel is delivered to the engine cylinders.

The lubrication oil is introduced from the inlet 9 into the rear portion 2*a* and then flows through the first oil passageway 10 into the bore 6 between the bearings 8*a*, 8*b*. In the bore 6 the lubrication oil flows in opposite directions along the drive shaft 7 toward the bearings 8*a*, 8*b*. Then the lubrication oil passes through clearances between the drive shaft 7 and the bearings 8*a*, 8*b* during which time fluid-film lubrication is effected. The lubrication oil flows through the second oil passageway 11*a*, 11*b* and then through the third oil passageway 12 into the cam chamber 5 where it lubricates movable parts such as the drive shaft 7, the coupling 25 and the cam disc 24. When the level of the lubrication oil exceeds the overflow port 54, the lubrication oil is allowed to flow outwardly through the port 54 and then to return to the oil tank.

As described above, the distributor-type fuel injection pump according to the invention has a magnetic valve disposed on the head portion of a pump body and is characterized by a pair of oil seals disposed on opposite sides of the feed pump, and a bypass passage bypassing the cam chamber and connecting a discharge side of the feed pump and an inlet side of the magnetic valve. With this construction, the fuel is delivered without passing through the cam chamber whereas the lubrication oil is introduced into the cam chamber through clearances between the drive shaft and the bearings and through passageways defined in the drive shaft. The cam assembly or other movable components are lubricated exclusively with the lubrication oil. As a result, the fuel injection pump operates stably over an extended period of time. Since the flow of the lubrication oil is choked or limited as the lubrication oil flows through the clearances between the drive shaft and the bearings, an adequate supply of lubrication oil to the cam chamber is maintained. The fuel supply mechamism constituted by the first to third passageways is simple in construction and can be manufactured at low cost. A further advantage is in that choking effect is achieved by full fluid-film lubrication provided between the bearings and the drive shaft. This lubrication mode is free from solidification of the lublication oil which would otherwise occur when an orifice is employed.

Obviously, many modifications and variations of the present invention are possible in the light of the above teachings. It is therefore to be understood that within the scope of the appended claims, the invention may be practiced otherwise than as specifically described.

What is claimed is:

1. A distributor-type fuel injection pump comprising:

(a) a pump body including a rear portion and a head portion remote from said rear portion, said rear portion having a first bore and said head portion having a second bore extending in alignment with said first bore;

(b) a drive shaft rotatably mounted in said first bore via at least two bearings;

(c) a feed pump disposed in said pump body adjacent to said rear portion and connected in driven relation to said drive shaft, there being defined between said feed pump and said head portion a cam chamber;

(d) a plunger slidably mounted in said second bore and defining between said second bore a pump working chamber;

(e) a cam disposed in said cam chamber and connecting said drive shaft with said plunger so as to cause the latter to take rotational and reciprocating motions simultaneously, in unision with the rotation of said drive shaft;

(f) a magnetic valve disposed on said head portion for opening and closing a fuel passage communicating with said pump working chamber;

(g) a pair of oil seals mounted around said drive shaft and disposed on opposite sides of said feed pump;

(h) said rear portion further having a first passageway communicating with said first bore between said two bearings for introducing a lubrication oil into a space defined between said first bore, said drive shaft and said bearings;

(i) said drive shaft having at least one second oil passageway extending diametrically therethrough and opening at opposite ends to one of said bearings, and a third oil passageway extending axially therein and communicating said second oil passageway with said cam chamber; and (j) a bypass passage bypassing said cam chamber ans communicating a discharge side of said feed pump with an inlet side of said fuel passage of said magnetic valve.

2. A distributor-type fuel injection pump according to claim 1, said bearings comprising plain bearings.

3. A distributor-type fuel injection pump according to claim 1, wherein said at least one second oil passageway includes two second oil passageways, both opening at at least one end to said bearings.

4. A distributor-type fuel injection pump according to claim 3, both of said second oil passageways extending diametrically through said drive shaft and opening at opposite ends to said bearings.

5. A distributor-type fuel injection pump according to claim 1, said bypass passage including a pipe disposed outside of said pump body and connecting said discharge side of said feed pump with said head portion, said head portion including at least one suction groove connecting said pipe with said passage of said magnetic valve.

6. A distributor-type fuel injection pump according to claim 1, further including an overflow port defined in said pump body and communicating with said cam chamber at a predetermined level thereof.

* * * * *